United States Patent [19]

Hodges

[11] Patent Number: 4,657,652

[45] Date of Patent: Apr. 14, 1987

[54] ELECTROLYTIC CELL AND ANODE FOR BRINE ELECTROLYTES

[75] Inventor: Jimmie R. Hodges, Federal Way, Wash.

[73] Assignee: Pennwalt Corporation, Philadelphia, Pa.

[21] Appl. No.: 834,719

[22] Filed: Feb. 28, 1986

[51] Int. Cl.[4] ..... C25B 11/08; C25B 11/10

[52] U.S. Cl. ..... 204/269; 204/286; 204/290 R

[58] Field of Search ..... 204/269, 275, 286, 290 R

[56] References Cited

U.S. PATENT DOCUMENTS

| | | | |
|---|---|---|---|
| 3,625,838 | 12/1971 | Jessup et al. | 204/290 R |
| 3,824,172 | 7/1974 | Hodges | 204/269 |
| 3,928,167 | 12/1975 | Buoy et al. | 204/290 R |
| 4,075,077 | 2/1978 | Hodges | 204/269 |
| 4,181,585 | 1/1980 | Pangborn | 204/290 R |
| 4,194,953 | 3/1980 | Hatherly | 204/290 R |
| 4,551,219 | 11/1985 | Flick et al. | 204/290 R |

FOREIGN PATENT DOCUMENTS

| | | | |
|---|---|---|---|
| 752433 | 12/1970 | Belgium | 204/290 R |
| 0005674 | 11/1979 | European Pat. Off. | 204/290 R |
| 0070296 | 4/1982 | Japan | 204/290 R |
| 0082498 | 5/1982 | Japan | 204/290 R |

*Primary Examiner*—Terryence Chapman

[57] ABSTRACT

An electrolytic cell for the production of halogen and halates from a corresponding brine electrolyte which includes a novel anode with each anode having an associated pair of cathodes, said anode comprises an aluminum core having a sheath of a titanium group metal and an electrolytic conductive precious metal coating as the outermost layer, to provide a cell without submerged gaskets and elimination of the normal steel corrosion at liquid-gas interfaces.

20 Claims, 10 Drawing Figures

ELECTROLYTIC CELL AND ANODE FOR BRINE ELECTROLYTES

BACKGROUND OF INVENTION

This invention relates to electrolytic cells for the manufacture of halogen or halates from their corresponding brine electrolytes.

An electrolytic cell of the general type to which this invention relates is illustrated in U.S. Pat. Nos. 3,824,172 and 4,075,077.

More particularly, the cell of this invention includes an improved, novel anode that is constructed of an aluminum-titanium composite material to provide a lightweight, inexpensive, highly conductive critical component for a cell which will operate at high amperage and low to medium current density to produce a greater amount of halogen or halate product at a lower power consumption than a comparable cell utilizing prior art solid titanium anodes.

Typical electrolytic cells for halogen and halate production comprise solid titanium plates disposed between cathode plates.

Titanium has been employed in the past as the anode base or core because of its high resistance to the electrolyte brine solution. However, because of the tendency of a non-conducting oxide film to form on the titanium surface in the brine, a precious metals coating in the instant invention is applied over the outer surface of the titanium anode to prevent the film formation and provide a highly conductive surface. If the highly conductive precious metal coating over the anode wears through during operation of the cell, the titanium base assures that the anode structure will not erode further.

Aluminum has not been used heretofore as an anode core material because it is incompatible with the cell environment, i.e, the brine electrolyte and halogen or chlorate product within the operating cell. Aluminum would otherwise be a desirable anode material as it is highly electroconductive, lightweight, and relatively inexpensive. Aluminum cored, titanium sheathed conductors positioned outside the cell environment of electrolytic cells are known and are shown, for example, in U.S. Pat. No. 3,857,774. However, an aluminum containing anode wherein the aluminum component is immersed in the brine electrolyte of the cell has heretofore not been utilized.

In the present invention submerged gaskets in electrolyte solution have been eliminated. Such prior art submerged gaskets have presented a serious source of problems. Moreover, the present invention eliminates the normal steel corrosion that occurs in conventional cells at the gas-liquid interface of the cell interior. Such corrosion is eliminated with the use of titanium explosive bonded to the steel flange which is welded to the container wall. The titanium bonding extends into the interior of the container to a point at least below the normal electrolyte fluid level, thereby completely submerging the steel in the cell liquid where it is cathodically protected from corrosion. In the area of normal maximal corrosion at the gas-liquid interface titanium is in contact with the electrolyte, thereby eliminating the corrosion.

Because the titanium is operating as a cathode, a special alpha form of titanium, which is extremely low in iron content, is used as such low iron content titanium is relatively immune to the normal cathodic corrosion exhibited by titanium. The titanium head is welded to the flange which makes a continuous gasket free system. The only gaskets are the electrically insulating gaskets between the cover and the head-container assembly which is a relatively problem free area for such a gasket.

In the present invention, because the current is conducted through the thickness of the titanium which is usually in the order of 0.030 inches or less, there is a negligible effect on the voltage of the cell. The entire aluminum or copper structure is available as the active anode. Accordingly, at comparable current density, the cell of this invention consumes sufficiently less power than the standard prior art anode design of earlier cells.

SUMMARY OF INVENTION

The cell of this invention is defined as an electrolytic cell for the production of halogens or halates from their corresponding brine electrolytes, comprising:

(a) an electrically conductive container for said electrolytes having a removable cover electrically insulated from a lower portion of the container;

(b) an anode affixed to said cover and associated pairs of cathodes that are electrically connected to said lower portion of the container with said anode and cathodes being adapted to be operatively positioned within said container such that a least a portion within said container is overlapped by each adjacent cathode and the cathodes and anode are adapted to be immersed in said electrolytes, said anode comprising:

(i) a self supporting aluminum core, (ii) a sheath of metal from the titanium group completely covering at least that portion of said core that is disposed to be located within the interior of the container during cell operation, and (iii) an electroconductive coating of precious metal covering at least that portion of said anode and sheath that is overlapped by an adjacent cathode in (b);

(c) means for applying a DC voltage between the anode and said lower portion of the container;

(d) means for introducing brine electrolyte into said lower portion of the container, and (e) means for withdrawing from said container halogens or halates produced by electrolysis of said brine.

Preferably, an extended end portion of said anode is adapted to extend through a slot in the cover of the cell container for electrical contact with an electrical connector.

It is desired for at least a portion of the anode that is adapted to extend through said slot and exterior of said container be free of the sheath of (b) (ii) and have a copper layer bonded directly to the aluminum core within said sheath-free extended portion of the anode. Preferably, the copper layer is explosive bonded to the aluminum core.

Preferably, the aluminum core is of a flat, planar shape and the sheath comprises titanium layers bonded to the front and back surfaces of the core with an associated U-shaped titanium channel member covering the exposed aluminum edges of the titanium layered core and overlapping said titanium layers to provide a fluid tight joint. It is preferred that the anode end portion be welded to the cover at the point of its passage through the slot to provide a fluid tight seal between said anode end portion and said cover.

Preferably, the cell has a plurality of anodes and for each anode there is an associated pair of cathodes spaced from and parallel to each anode.

It is desired that the cathodes have a plurality of slots, be vertically oriented with vertical margins, horizontally spaced and substantially flat. It is also desirable for the vertical margins of the cathodes to be welded to vertical wall portions of container.

In a particular embodiment of the invention the cover has an associated raised mainfold for collecting gas produced at the anodes and cathodes during electrolysis of the brine.

It is preferred that the anode sheath be comprised of a metal selected from the group consisting essentially of titanium, zirconium, tantalum, and hafnium.

The preferred anode coating in (b) (iii) is a precious metal coating selected from the group consisting of platinum-iridium alloy, and ruthenium oxide.

It is preferred that the upper portion of the container periphery have a steel flange extending exterior of the container with the flange and at least the adjacent interior portion of the container that is adapted and disposed to be out of direct contact with said electrolyte during cell operation having explosively bonded to their surfaces a titanium group metal selected from the group consisting essentially of titanium, zirconium, tantalum, and hafnium, to provide a cell wherein in operation the container is cathodically protected from corrosion. The preferred metal for explosive bonding to the flange and interior portion is alpha-titanium.

It is most desirable for the portion of the cover that is adapted to contact the topmost portion of the flange consisting essentially of titanium be welded to said flange to provide a fluid tight container that is free of gaskets in electrolyte containing portions of the container when in operation.

The invention also includes the novel anode per se as above described.

DESCRIPTION OF A PREFERRED EMBODIMENT

Figure 1:
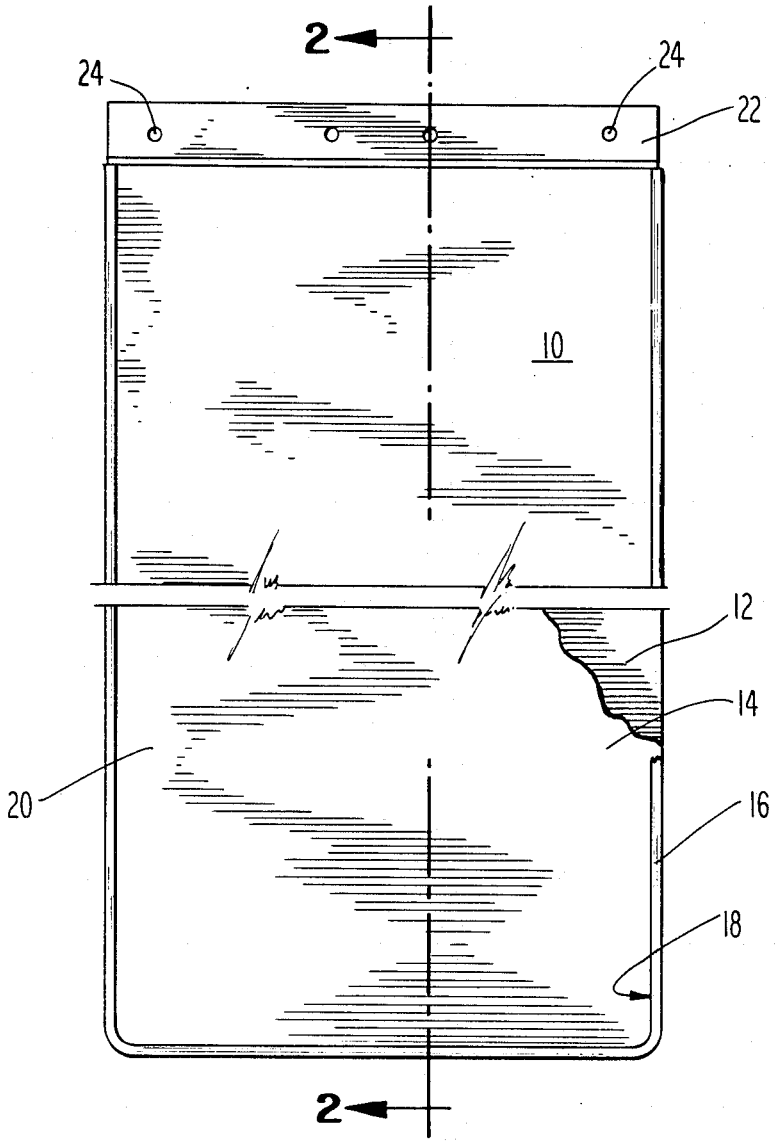
FIG. 1 is a front, partial sectional view of the anode of this invention.

FIG. 1 of the drawings depicts anode 10 of this invention and includes in the anode construction a self supporting, planar aluminum core 12 to which the titanium layer 14 is a bonded to provide a strong metallurgical, electroconductive bond. The side and bottom edges of the titanium clad aluminum sheet are enveloped with a "U"-shaped, titanium channel member 16 which is sealed by welding, titanium to titanium, at 18 around the edges thereof on both sides of the anode to prevent crevical corrosion of the titanium and to assure that the cell electrolyte will not contact the aluminum core 12 by providing a fluid tight joint.

For the purposes of this invention, "titanium" is intended to include metals of the titanium group, i.e. titanium, zirconium, tantalum, and hafnium, and alloys of such metals which have substantially equivalent corrosion resistance properties to titanium.

A highly conductive precious metal 20 is applied at least to that portion of the surface of the anode that is overlapped by adjacent cathodes 34 and 36 during cell operation but the coating can, and generally does, cover the entire titanium surface of at least that portion of the anode which is within the cell container. The precious metal coating 20 is either a free metal, an alloy, or a metal compound and may be, for example, platinum, a platinum-iridium alloy or ruthenium oxide which is applied by methods well known in the art.

Figure 2:
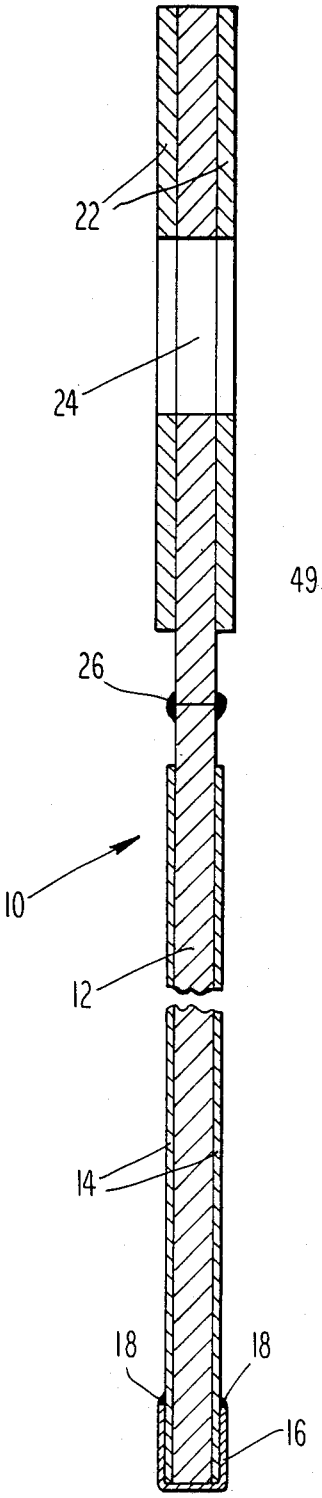
FIG. 2 is an enlarged side view in cross section of the anode 10 of the invention taken along line 2—2 of FIG. 1.

At the top of anode 10 as shown in FIG. 1 a copper sheet or pad 22 is secured to at least one side of the upper extension of the aluminum of the anode 10 to provide maximum electrical current flow between the anode 10 and electrical connectors fastened at holes 24. Copper 22 is preferably bonded to both sides of the aluminum core 12 as shown in FIG. 2. To insure a high degree and efficiency of electrical transfer from copper pad 22 to aluminum core 12, the copper is secured to the aluminum by explosive bonding, a well known technique which provides a strong, permanent metallurgical and electroconductive bond. For convenience of fabrication, preferably copper pads 22 are first bonded to both sides of an aluminum sheet of about the thickness and width of the anode core and slightly higher than the height of the copper pads 22. The aluminum bottom end of this composite is then welded to the aluminum core at upper end 26 as shown in FIG. 2 to thereby become an extension of anode structure 10.

Figure 3:
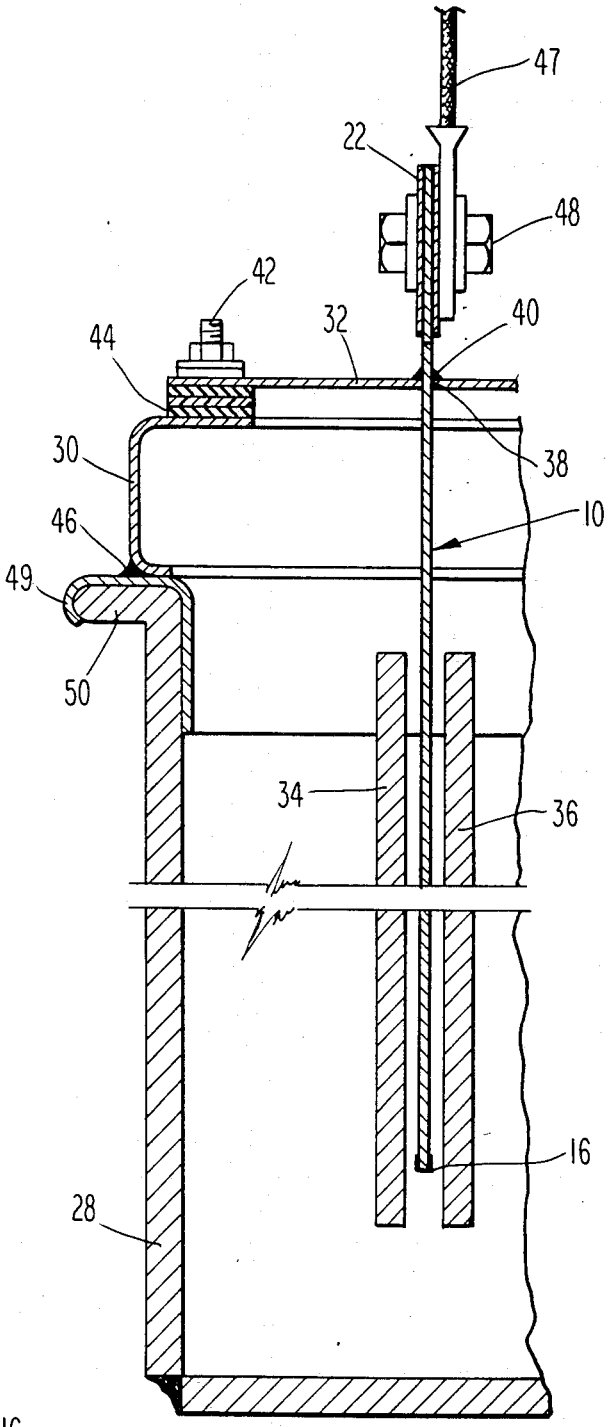
FIG. 3 is a broken side, cross sectional view of cell container 28 including the anode 10 positioned between two adjacent cathodes 34 and 36.

In FIG. 3 of the drawings a broken side view of a monopolar cell containing the anode is shown. As depicted, the cell consists generally of a fluid tight container 28 with an extended upper portion commonly referred to as a headboard 30, a cover plate 32 and cathode plates 34 and 36.

Figure 10:
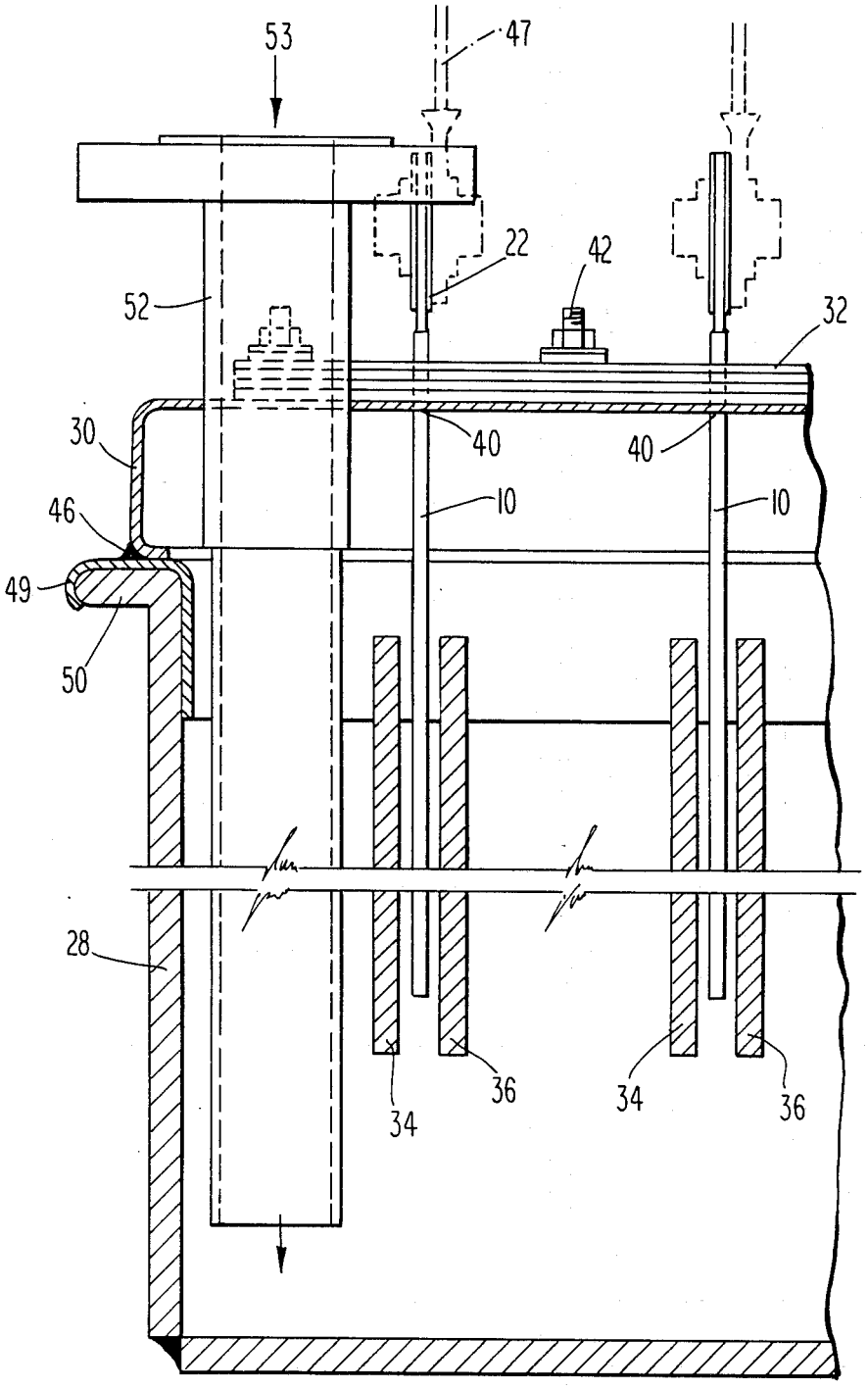
FIG. 10 is a fragmentary, sectional view taken through line 10—10 of FIG. 5.

In preferred practice, there are a plurality of anodes 10 in the cell, each positioned between a pair of cathodes 34 and 36 as illustrated in FIG. 10. To prevent corrosion, cover plate 32 and the headboard 30 are preferably solid titanium or a titanium alloy, but the cell components could also be titanium clad steel or some other suitable metal core material. Cover plate 32 is bolted to the headboard 30 with bolts 42.

Each anode is inserted through its respective slot 38 in cover plate 32 and welded at the edges of slot 38 of cover plate at 40. Cover plate 32 is bolted to headboard 30 by means of nut and bolt assembly 42 and electrical gasket 44. Headboard 30 is preferably fastened to the cell container 28 by titanium welding 46 to flange 50 having titanium clad thereon or shown by 49. An electrical connector, preferably of flexible copper braid, is fastened to the upper end of each anode 10 by means of fastener assemblies 48 through holes 24.

Cathodes 34 and 36 at their ends are in electrical contact with opposite side walls of metal cell container 28. Preferably, cathodes 34 and 36 are welded at their vertical margins to the container side walls. Electrical bussbars 56 are attached to the outer container walls to which cathode edges make contact on the inside, thereby supplying current to the cathodes. A similiar prior art attachment of cathodes to container walls is shown in U.S. Pat. No. 4,075,077 to J. R. Hodges, that issued Feb. 21, 1978. Adjacent cells can be connected in series, e.g., through intercell bussbars 57. Anode current collector bars are shown as 55 and are electrically connected to straps 47 through associated parts 58, 59 60, 61 and 62.

Appropriate intake and outlets for the brine and electrolysis products are illustrated in FIGS. 4, 5,6,7, and 10. Inlet pipes are indicated as 52 with inlet passageways referred to as 53. Outlet pipe 63 with passageway 64 provides for the discharge of fluids and gas from the cell.

Figure 5:
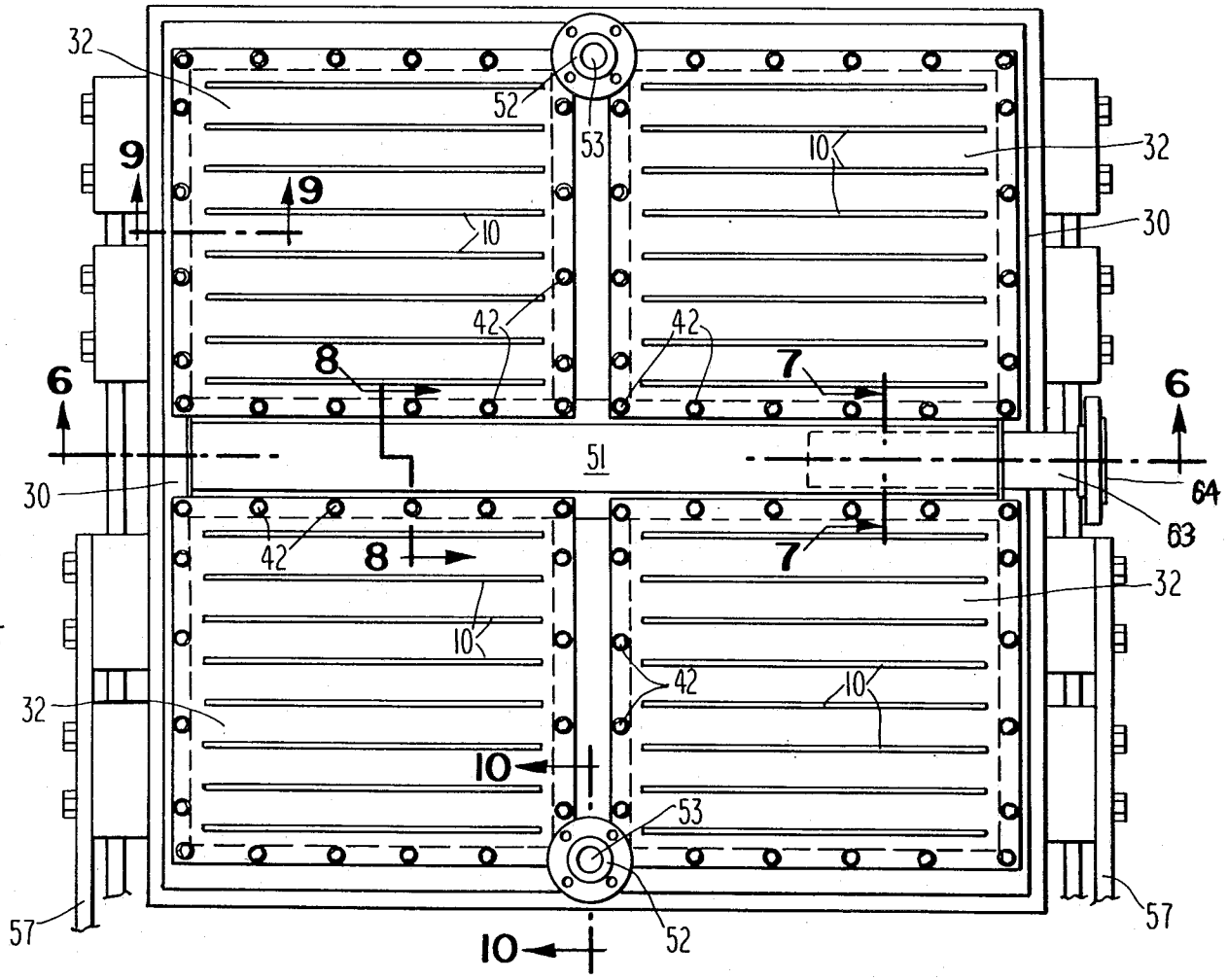
FIG. 5 is a top plan view of a cell of this invention with the buss work at the top of the cell broken away for clarity.
Figure 6:
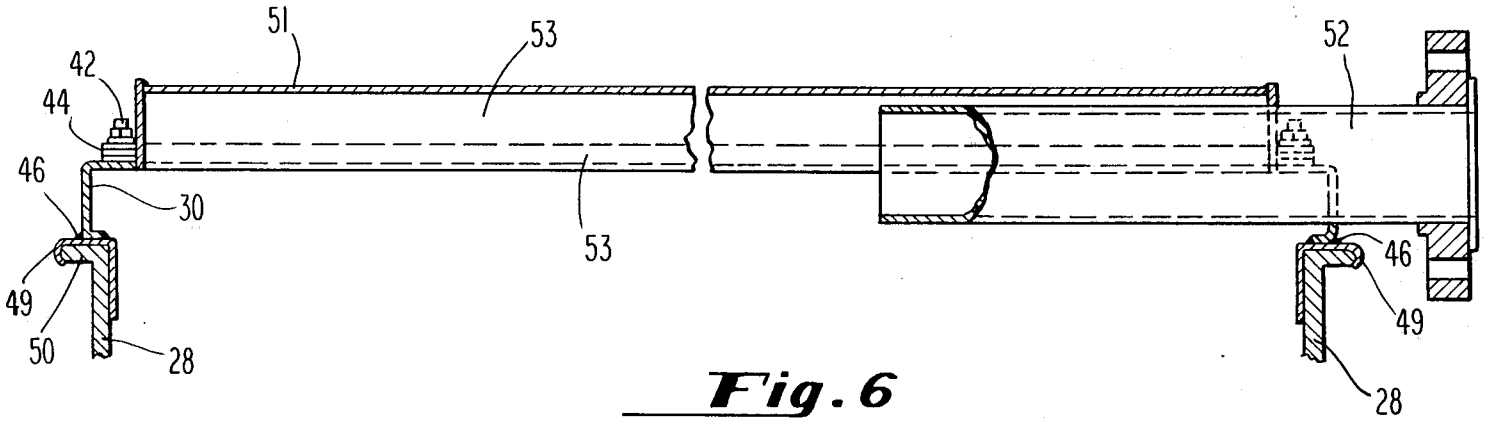
FIG. 6 is a fragmentary, sectional view taken through line 6—6 of FIG. 5.
Figure 7:
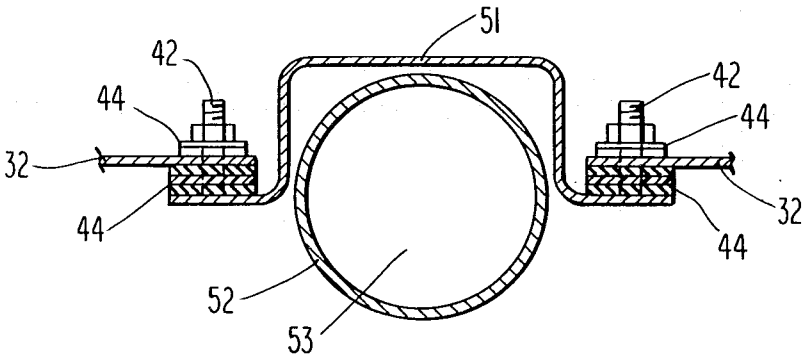
FIG. 7 is a fragmentary, sectional view taken through line 7—7 of FIG. 5.

With reference to FIGS. 5, 6, and 7, raised manifold 51 provides for and facilitates collection and discharge of brine, gases, and other products of the electrolysis through passageway 53 of outlet pipe 52.

Figure 8:
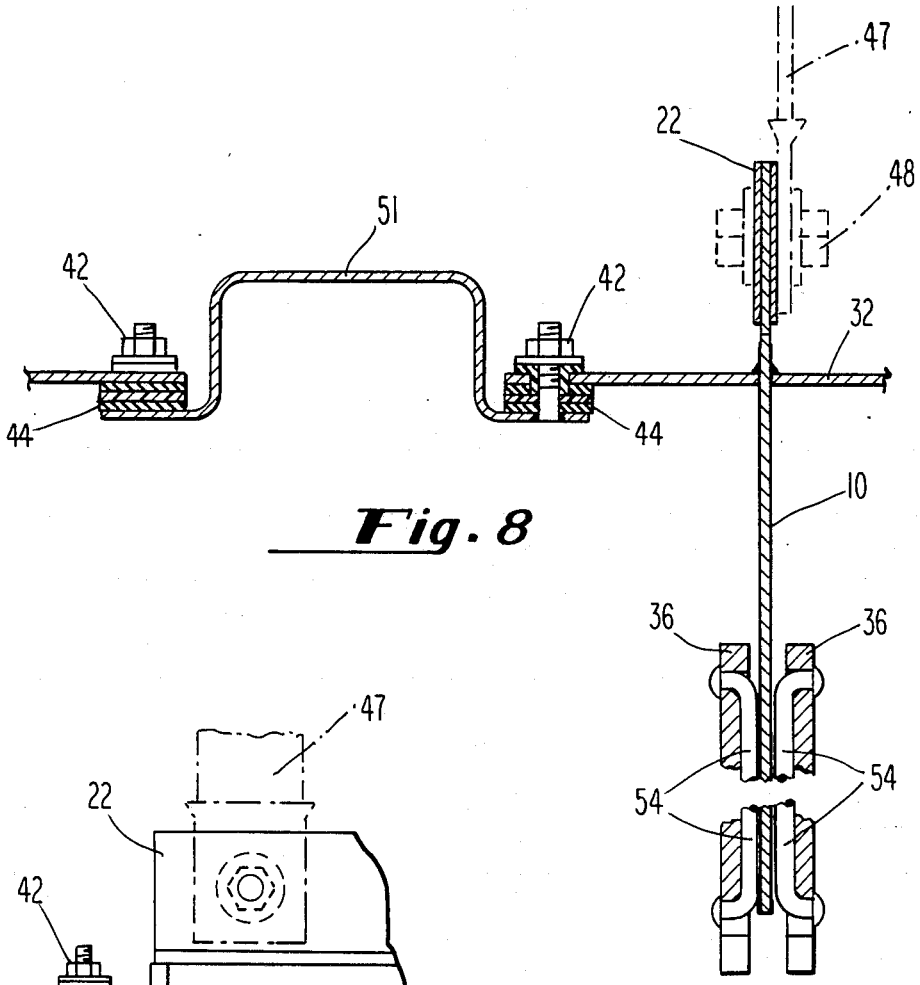
FIG. 8 is a fragmentary, sectional view taken through line 8—8 of FIG. 5.
Figure 9:
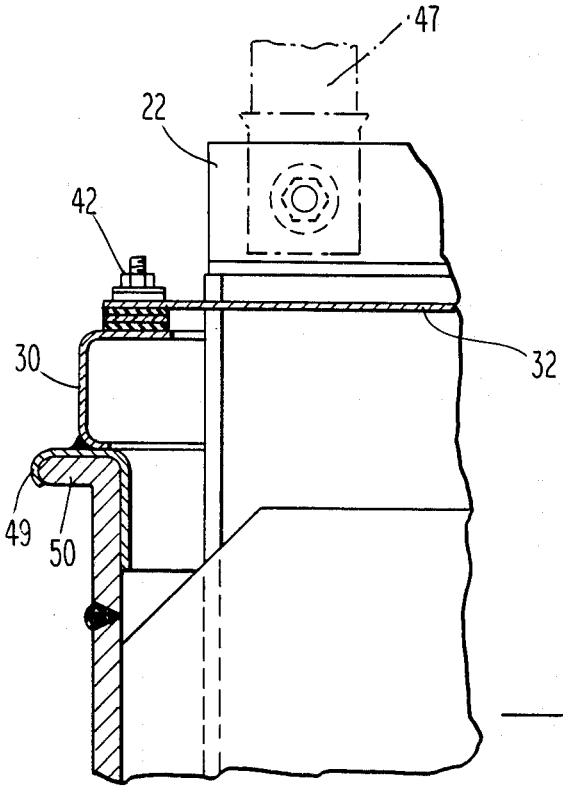
FIG. 9 is a fragmentary, sectional view taken through line 9—9 of FIG. 5.

With reference to FIG. 8, cathode plates 34 and 36 are preferably retained and spaced from anode 10 through retainer means 54 of a non-conductive material of high corrosion resistance, such as polyvinylidene flouride or polytetrafluorethylene.

Preferably, the container of the cell 28 has a flange around its upper periphery 50 with a titanium coating 49 thereon which extends into the interior of the container and covers at least the portion of the container that is not covered with an electrolyte solution during operation. The headboard section 30 is then titanium welded 46 to the flange about the periphery and the cover plate 32 is adapted to be attached to the headboard 30 by means of bolt 42 and electrically insulating gasket means 44.

Figure 4:
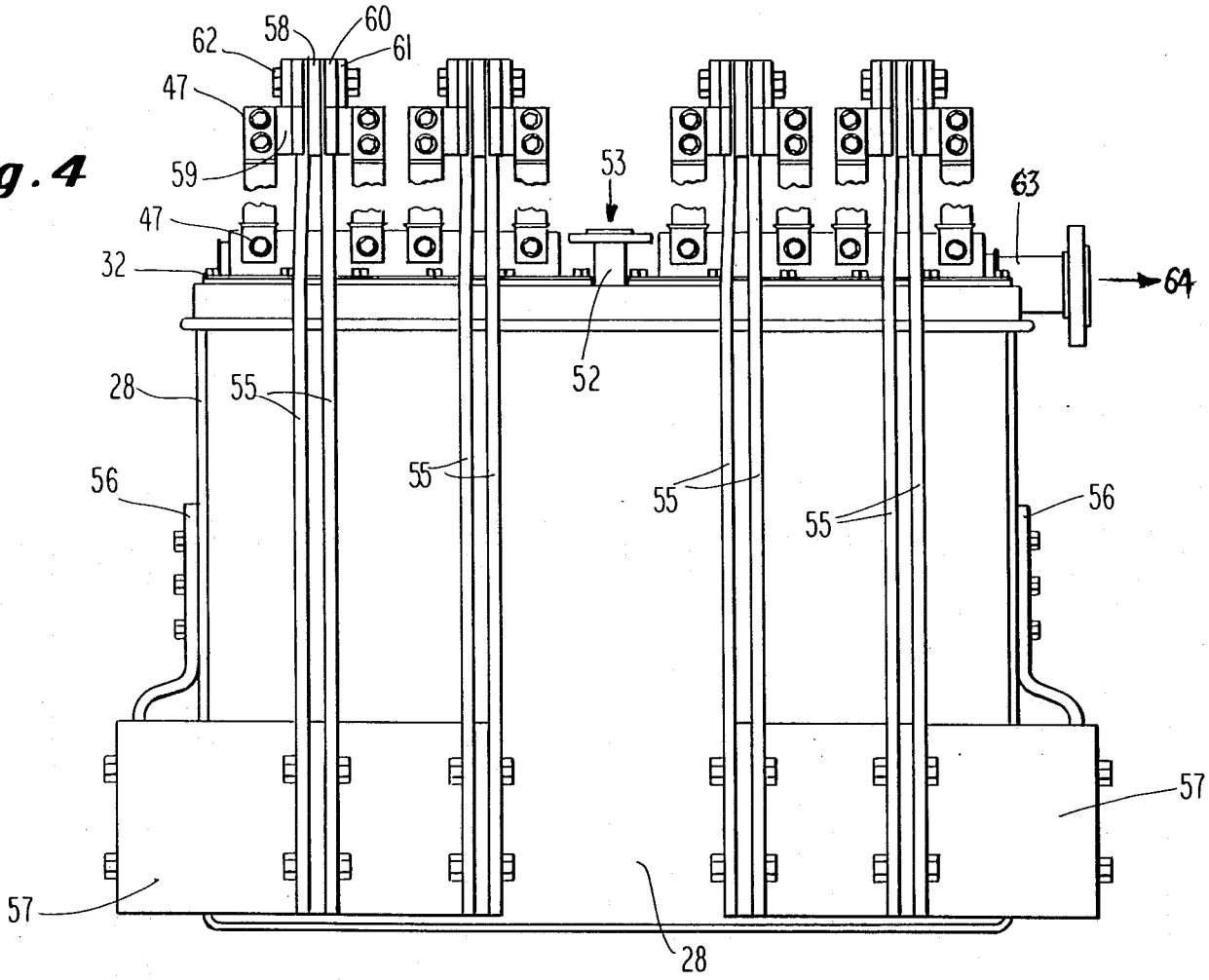
FIG. 4 is a front elevational view of a cell of this invention showing the associated buss work.

With reference to FIGS. 4 and 5, cathode current collectors 56 are shown and intercell bussbars are shown as 57. Anode current collector bussbars are shown as 55 and the anode current strap, which is commonly a copper braided material, as 47. Bolts and fastening means for attachment of the anode collector bars 55 to strap 47 are shown as parts 58, 59, 60, 61, and 62.

The remainder of the materials of construction, dimensions and fabrication procedures for the cell are well known in the art, see, for example, U.S. Pat. No. 4,075,077. Typically, each cell container has thirty-two anodes with thirty-two pairs of associated cathodes.

I claim:

1. An electrolytic cell for the production of halogens or halates from their corresponding brine electrolytes, consisting essentially of:

(a) an electrically conductive container for said electrolytes having a removable cover electrically insulated from a lower portion of the container;

(b) an anode affixed to said cover and associated pairs of cathodes that are electrically connected to said lower portion of the container with said anode and cathodes being adapted to be operatively positioned within said container such that at least a portion of the anode is overlapped by each adjacent cathode and the cathodes and anode are adapted to be immersed in said electrolytes, said anode consisting essentially of:

(i) a self supporting aluminum core, (ii) a sheath of metal from the titanium group completely covering at least that portion of said core that is disposed to be located within the interior of the container during cell operation, and (iii) an electroconductive coating of precious metal covering at least that portion of said anode and sheath that is overlapped by an adjacent cathode in (b);

(c) means for applying a DC voltage between the anode and said lower portion of the container;

(d) means for introducing brine electrolyte into said lower portion of the container, and (e) means for withdrawing from said container halogens or halates produced by electrolysis of said brine.

2. The cell of claim 1 wherein in (b) an extended end portion of said anode is adapted to extend through a slot in the cover of the cell container for electrical contact with an electrical connector.

3. The cell of claim 2 wherein at least a portion of the anode that is adapted to extend through said slot and exterior of said container is free of the sheath of (b) (ii) and has a copper layer bonded directly to the aluminum core within said sheath-free extended portion of the anode.

4. The cell of claim 3 wherein in (b) said copper layer is explosive bonded to the aluminum core.

5. The cell of claim 2 wherein in (b) said aluminum core has a flat, planar shape and the sheath comprises titanium layers bonded to the front and back surfaces of the core with an associated U-shaped titanium channel member covering exposed aluminum edges of the titanium layered core and overlapping said titanium layers to provide a fluid tight joint.

6. The cell of claim 2 wherein the anode end portion is welded to the cover to provide a fluid tight seal between said anode end portion and said cover.

7. The cell as in claim 1 having a plurality of anodes and for each anode there is an associated pair of cathodes spaced from and parallel to each anode.

8. The cell of claim 7 in which said cathodes have a plurality of slots, are vertically oriented with vertical margins, horizontally spaced and substantially flat and said anodes are vertically oriented, horizontally spaced and substantially flat.

9. The cell as in claim 8 wherein the vertical margins of said cathodes are welded to vertical wall portions of said container.

10. The cell as in claim 9 wherein said cover has an associated raised manifold means disposed exterior of the container for collecting gas produced at said anodes and cathodes during electrolysis of said brine.

11. The cell as in claims 1,2,3,4,5,6,7,8,9, or 10 wherein in (b)(ii) said anode sheath is comprised of a metal selected from the group consisting essentially of titanium, zirconium, tantalum, and hafnium.

12. The cell as in claim 11 wherein the anode in (b)(iii) is coated with a precious metal coating selected form the group consisting essentially of platinum, platinum-iridium alloy, and ruthenium oxide.

13. The cell as in claims 1,2,3,4,5,6,7,8,9, or 10 wherein the upper portion of the container periphery has a steel flange extending exterior of the container, said flange and at least an adjacent interior portion of the cointainer that is adapted and disposed to be out of direct contact with said electrolyte during cell operation having explosive bonded to their surface a titanium group metal selected from the group consisting essentially of titanium, zirconium, tantalum, and hafnium, to provide a cell wherein in operation the container is cathodically protected from corrosion.

14. The cell as in claim 13 wherein the titanium group metal is alpha-titanium.

15. The cell as in claim 13 wherein the upper portion of the container, intermediate of the flange and cover, that is adapted to contact a topmost portion of the flange consists essentially of titanium and is welded to said flange to provide a fluid tight container that is free of gaskets in electrolyte containing portions of the container when in operation.

16. An anode, useful in an electrolytic cell for the production of halogens or halates from their corresponding brine electrolytes, consisting essentially of:

(a) a self supporting aluminum core having at least a portion that is adapted to be located within the interior of the cell and at least a part of said portion being adapted to be overlapped by adjacent cathodes;

(b) a sheath of metal from the titanium group completely covering at least that portion of said core that is adapted to be located within the interior of the cell;

(c) an electroconductive coating of precious metal covering at least said overlapped part of said anode and sheath; and (d) an extended end being adapted to extend through a slot in a cover for the cell container for electrical contact with an electrical connector and at least a portion of the extended end being free of the sheath of 1(b) and having a copper layer bonded directly to the aluminum core within the sheath-free extended end portion of the anode.

17. The anode of claim 16 wherein said copper layer in (d) is explosive bonded to the aluminum core.

18. The anode of claim 16 wherein said aluminum core has a flat, planar shape and the sheath comprises titanium layers bonded to the front and back planar surfaces of the core with an associated U-shaped titanium channel member covering the exposed aluminum edges of the titanium layered core and overlapping said titanium layers to provide a fluid tight joint.

19. The anode as in claims 16, 17, or 18 wherein said sheath is comprised of a metal selected from the group consisting essentially of titanium, zirconium, tantalum, and hafnium.

20. The anode as in claim 19 wherein the electroconductive coating is a precious metal coating selected from the group consisting essentially of platinum, platinum-iridium alloy, and ruthenium oxide.

* * * * *